US008573161B2

(12) United States Patent
Min

(10) Patent No.: US 8,573,161 B2
(45) Date of Patent: Nov. 5, 2013

(54) HOT-WATER SUPPLY SYSTEM HAVING DUAL PIPE

(75) Inventor: Tae-Sik Min, Dongjak-gu (KR)

(73) Assignee: Kyungdong Navien Co., Ltd., Gyunggi-Do (KR)

( * ) Notice: Subject to any disclaimer, the term of this patent is extended or adjusted under 35 U.S.C. 154(b) by 944 days.

(21) Appl. No.: 11/885,523

(22) PCT Filed: Mar. 7, 2006

(86) PCT No.: PCT/KR2006/000780

§ 371 (c)(1), (2), (4) Date: Apr. 24, 2008

(87) PCT Pub. No.: WO2006/109927

PCT Pub. Date: Oct. 19, 2006

(65) Prior Publication Data

US 2008/0277097 A1 Nov. 13, 2008

(30) Foreign Application Priority Data

Mar. 7, 2005 (KR) ..... 10-2005-0018793

(51) Int. Cl.
*F22B 1/02* (2006.01)

(52) U.S. Cl.
USPC ..... 122/31.1; 122/32; 165/104.14

(58) Field of Classification Search
USPC ..... 165/156, 104.14, 104.19, 164, 168; 122/40, 17, 31.1, 32
See application file for complete search history.

(56) References Cited

U.S. PATENT DOCUMENTS

| | | | | |
|---|---|---|---|---|
| 1,851,851 | A * | 3/1932 | Lee et al. | 122/166.1 |
| 2,633,108 | A | 10/1950 | Sterick | |
| 3,815,813 | A * | 6/1974 | Charron et al. | 236/23 |
| 5,403,180 | A * | 4/1995 | Chato | 431/1 |

(Continued)

FOREIGN PATENT DOCUMENTS

| | | |
|---|---|---|
| CN | 2535750 | 2/2003 |
| CN | 2632613 | 8/2004 |

(Continued)

OTHER PUBLICATIONS

International Search Report for Application No. PCT/KR2006/000780, dated May 26, 2006.

(Continued)

*Primary Examiner* — Gregory A Wilson

(74) *Attorney, Agent, or Firm* — Nelson Mullins Riley & Scarborough LLP

(57) ABSTRACT

Disclosed is a hot water supplying apparatus which has a dual pipe capable of transferring heat energy of hot water, which is heated by heat of combustion of a burner and flows in pipe of a heat exchanger, to an inner pipe in which cold water is introduced, thereby inhibiting the condensation of moisture so as to prevent the corrosion of parts in the hot water supplying apparatus. The hot water supplying apparatus, comprises: a burner for supplying heat; a water inlet pipe for supplying cold water; a heat exchanging pipe formed with a dual pipe including an outer pipe for directly receiving combustion heat of the burner, and an inner pipe formed in the outer pipe, for allowing the cold water, which is introduced through the water inlet pipe, to be heated while passing through the inner pipe; and a water outlet pipe for discharging the heated water from the heat exchanging pipe.

8 Claims, 2 Drawing Sheets

(56) References Cited

U.S. PATENT DOCUMENTS

| | | | | | |
|---|---|---|---|---|---|
| 5,596,953 | A | * | 1/1997 | Hong | 122/14.3 |
| 5,778,829 | A | * | 7/1998 | Min | 122/14.3 |
| 5,931,379 | A | * | 8/1999 | Kim | 237/8 A |
| 5,988,118 | A | * | 11/1999 | Park | 122/406.1 |

FOREIGN PATENT DOCUMENTS

| | | |
|---|---|---|
| CN | 2639825 | 9/2004 |
| DE | 1679796 | 4/1971 |
| FR | 1422247 | 12/1965 |
| FR | 2539219 | 7/1984 |
| JP | 49-146554 | 12/1974 |
| JP | 61-149769 | 7/1986 |
| JP | 61-198877 | 12/1986 |
| JP | 62-118975 | 7/1987 |
| JP | 9-210576 | 8/1997 |
| JP | 2000-146299 | 5/2000 |
| JP | 2005-180778 | 7/2005 |
| KR | 20-1985-0001607 | 7/1985 |
| KR | 10-2001-0007413 | 1/2001 |
| KR | 10-2003-0097212 | 12/2003 |

OTHER PUBLICATIONS

Japanese Office Action for Application No. 2008-500617, dated Nov. 8, 2011.

Japanese Office Action for Application No. 2008-500617, 3 pages, dated Oct. 23, 2012.

* cited by examiner

HOT-WATER SUPPLY SYSTEM HAVING DUAL PIPE

TECHNICAL FIELD

The present invention relates to a hot water supplying apparatus having a dual pipe, and more particularly to a hot water supplying apparatus, which includes a dual pipe in order to preheat cold water or returned calefactory water introduced through a water inlet pipe, thereby preventing pipes from corroding due to condensation of water on the pipes.

BACKGROUND ART

In general, a heat exchanging apparatus of a boiler is to absorb combustion heat generated from a burner, and includes heat exchanging pipes through which water flows and heat transferring fins for absorbing the combustion heat, so as to heat water using the combustion heat in order to make hot water.

FIG. 1 is a schematic view showing the structure of a conventional gas powered boiler.

In a heat exchanging apparatus 1, heat energy generated by a burner 20 is transferred to a heat exchanger 10 so as to heat water in the heat exchanger 10. The heated water is forcibly supplied to locations which require heating by a circulation pump (not shown), so as to transfer heat. At this time, a blower 30 is installed at a lower portion of the burner 20 in order to effectively transfer heat energy to the heat exchanger 10. Meanwhile, exhaust gas is discharged through a smoke tube 40.

The hot water circulated by the circulation pump transfers its heat to the locations which require heating, and then returns to the relatively cold water so as to be introduced through inlet into the heat exchanger 1. This process is repeated, the calefactory water is continuously circulated.

In the boiler having the above mentioned structure, when much time passes in the state that the operation of the boiler stops, all of pipes in the boiler, the heat exchanger, pipes connected from the boiler to rooms respectively, and pipes arranged in the rooms are fully filled with cold water of which temperature has dropped. Further, the temperature of water in the pipes for heating becomes lowered to level identical with temperature of air around the boiler.

When the boiler operates in a state that the temperature of the water in the heating pipe has been lowered, there occurs temperature difference between the cool water in the heating pipe and heated air due to the combustion of the burner.

Such a temperature difference seriously occurs in winter when a temperature of water in heating pipes is very low. Moisture, which is contained in the atmosphere, is condensed on a peripheral surface of pipes of the heat exchanger 10, so as to be condensate water.

Meanwhile, the calefactory water, which returns after transferring heat to locations which require heating, has a lowered temperature. Therefore, when the calefactory water of which the temperature is low passes through the pipes in the heat exchanger, the temperature difference between cold water in the pipe and the atmosphere heated to high temperature causes moisture contained in the atmosphere to condense on the peripheral surface of the pipes.

The water condensed on the peripheral surface of the pipe naturally evaporates. However, in a hot water supplying apparatus, combustion gas is generated and reacts with the condensed water so as to create acidic condensation water while fuel oil or gas is combusted in a combustion chamber.

Such acidic condensate water accelerates the corrosion of various parts, made of metal material, of the heat exchanger, thereby curtailing the lifetime of the heat exchanger.

DISCLOSURE OF INVENTION

Technical Problem

Accordingly, the present invention has been made to solve the above-mentioned problems occurring in the prior art, and an object of the present invention is to provide a hot water supplying apparatus having a dual pipe which can transfer heat energy from hot water within a heat exchanger heated by the combustion heat of a burner to an inner pipe in which cold water is introduced, thereby inhibiting the condensation of moisture so as to prevent the corrosion of parts in the hot water supplying apparatus.

Technical Solution

In order to accomplish the object of the present invention, there is provided a hot water supplying apparatus, which comprises: a burner for supplying heat; a water inlet pipe for supplying cold water; a heat exchanging pipe formed with a dual pipe including an outer pipe for directly receiving combustion heat of the burner, and an inner pipe formed in the outer pipe, for allowing the cold water, which is introduced through the water inlet pipe, to be heated while passing through the inner pipe; and a water outlet pipe for discharging the heated water from the heat exchanging pipe.

Further, a plurality of inner pipes is arranged in parallel, and inserted into the outer pipe.

Furthermore, the inner pipe is inserted to a desired depth into the outer pipe, while the cold water introduced into the inner pipe is blocked by a sidewall of the outer pipe so as to flow in opposite direction to an introduced direction.

In addition, caps for providing fluid path are installed to close one end of first and second heat exchanging pipes, through which the water inlet pipe extends.

According to the present invention, a return pipe is in contact with an outer wall of a combustion chamber for secondly heating water which is firstly heated in the inner pipe, and is connected to the outer pipe in order to thirdly heat the water heated in the return pipe.

Advantageous Effects

In the hot water supplying apparatus having a dual pipe according to the present invention, the first heat exchanging pipe connected to the water inlet pipe installed at an inlet port of the heat exchanger is formed with the dual pipe including the outer pipe and the inner pipe, so as to raise the temperature of the cold water introduced through the inlet pipe, thereby preventing the creation of the condensate water and the corrosion of the parts of a boiler.

BRIEF DESCRIPTION OF THE DRAWINGS

The above and other objects, features and advantages of the present invention will be more apparent from the following detailed description taken in conjunction with the accompanying drawings, in which.

BEST MODE FOR CARRYING OUT THE INVENTION

Hereinafter, the structure and operation of a hot water supplying apparatus according to the present invention will be described in detail with reference to the accompanying drawings.

Figure 1:
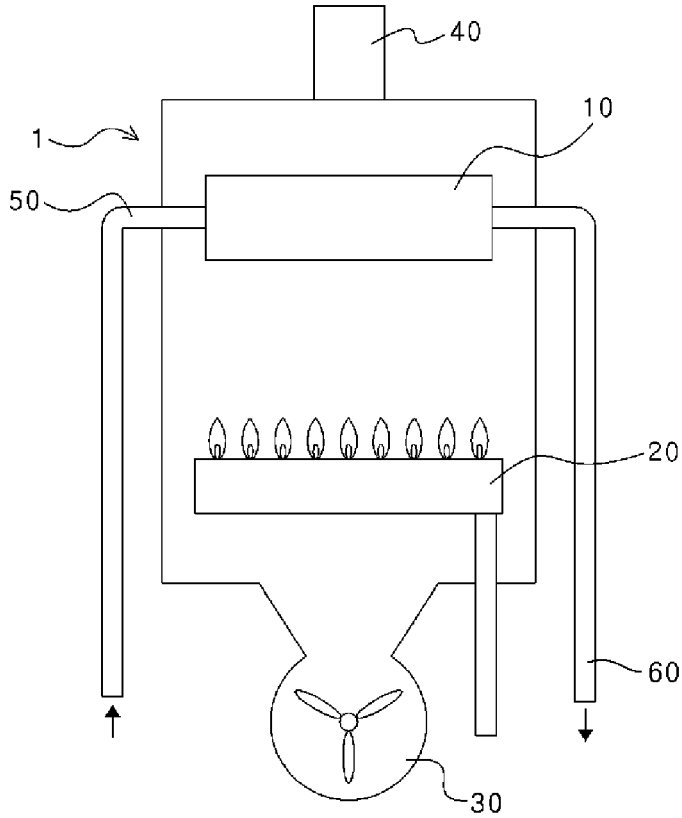
FIG. 1 is a schematic view showing the structure of a conventional gas boiler.
Figure 2:
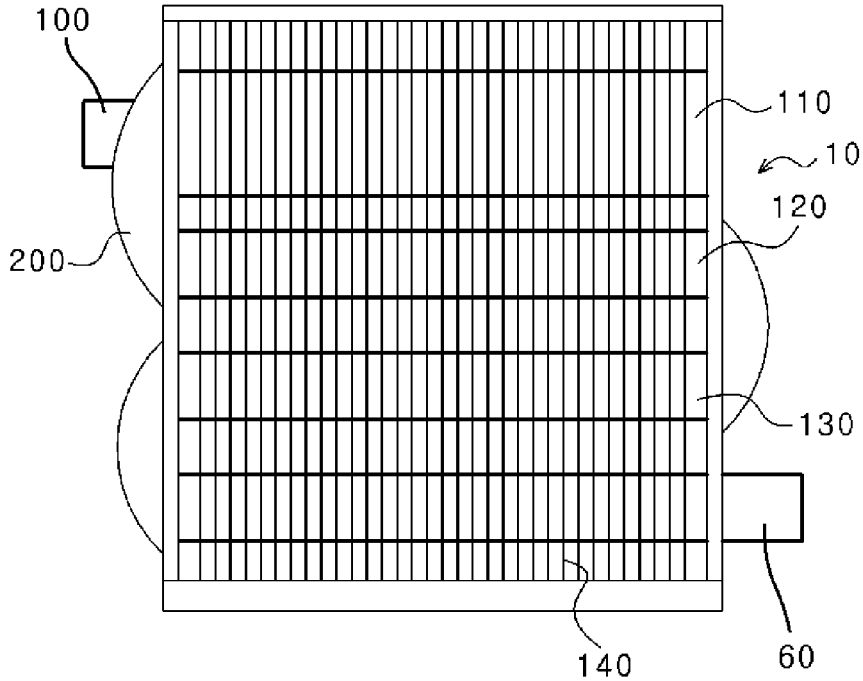
FIG. 2 is a schematic view showing a heat exchanger according to an embodiment of the present invention.
Figure 3:
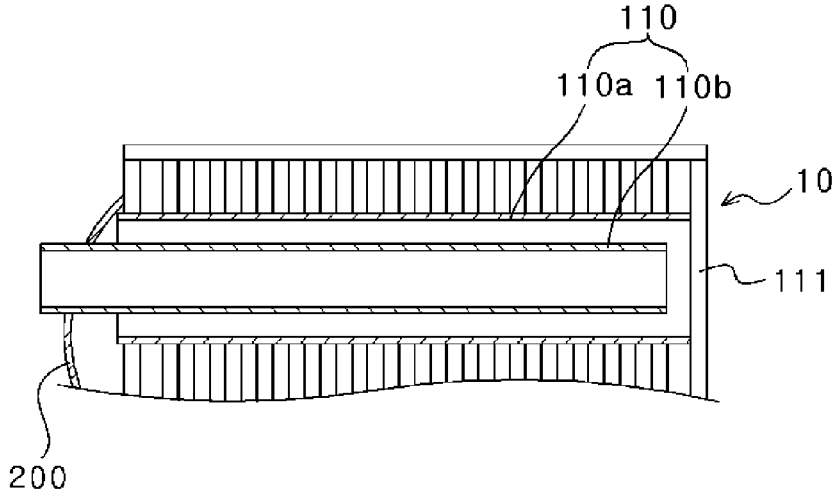
FIG. 3 is a schematic view showing a dual pipe according to the embodiment of the present invention.
Figure 4:
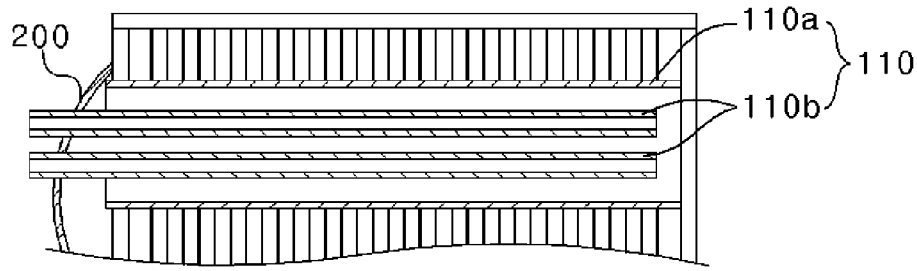
FIG. 4 is a schematic view showing a dual pipe according to another embodiment of the present invention.

FIG. 2 is a schematic view showing a heat exchanger according to an embodiment of the present invention, FIG. 3 is a schematic view showing a dual pipe according to the embodiment of the present invention, and FIG. 4 is a schematic view showing a dual pipe according to another embodiment of the present invention.

A water inlet pipe 100 is connected to an inlet port of a heat exchanging apparatus, through which either the returned calefactory water returning after heat exchange at places which require heating or direct water for supply of warm water is introduced. Further, a heat exchanger 10 including a plurality of heat exchanging pipes is mounted on an upper portion of a burner, and transfers heat energy from the burner to the calefactory water or cold water introduced through the water inlet pipe 100 in the heat exchanger. The hot water is supplied through only one water outlet pipe 60 to locations which require the hot water.

The heat exchanger 10 is provided with a plurality of heat exchanging pipes including a first heat exchanging pipe 110, a second heat exchanging pipe 120, and a third heat exchanging pipe 130 which are sequentially arranged, and heat transferring fins 140.

The cold water introduced through the water inlet pipe 100 into the heat exchanger is again introduced into the first heat exchanging pipe 110 which is formed with a dual pipe including an outer pipe 110*a* to which combustion heat is directly transferred from the burner 20, and an inner pipe 110*b* mounted in the outer pipe 110*a*.

The outer pipe 110*a* heated by the combustion heat of the burner 20 transfers heat to the inner pipe 110*b* using water filled therein as a medium. The transferred heat is again transferred to cold water introduced through the water inlet pipe 100 and filled within the inner pipe 110*b*, so as to heat the cold water. When the heat transfer is achieved, it is possible to prevent the creation of the condensate water on a peripheral surface of the outer pipe 110*a*.

The first heat exchanging pipe 110 is sequentially connected to the second and third heat exchanging pipes 120 and 130 which are formed with dual pipes including outer pipes 120*a* and 130*a*, and inner pipes 120*b* and 130*b*, respectively.

Preferably, the water inlet pipe 100 extends through a cap 200 to create a fluid path and is connected to the heat exchanger 10, as shown in FIGS. 2 and 3. In this case, one end of the first and second heat exchanging pipes 110 and 120 is covered with the cap 200, which connects fluid path of the first heat exchanging pipe 110 to fluid path of the second heat exchanging pipe 120.

The water inlet pipe 100 is connected to the inner pipe 110*b* of the first heat exchanging pipe 110. The inner pipe 110*b* is inserted into the outer pipe 110*a* to a desired depth, as shown in FIG. 3.

In this case, the cold water introduced into the water inlet pipe 100 flows along the inner pipe 110*b*, and then is blocked by a sidewall 111 of the first heat exchanging pipe 110 so as to flow along the outer pipe 110*a* in opposite direction.

The combustion heat generated by the burner is firstly transferred to the water filled within the outer pipe 110*a* of the first heat exchanging pipe 110, and then the heat is secondly transferred from the water filled in the outer pipe 110*a* to the cold water introduced into the inner pipe 110*b*. As a result, the temperature of the water introduced into the inner pipe 110*b* is raised. When the water introduced into the inner pipe 110*b* is heated, it is possible to prevent moisture from condensing on the pipes.

The calefactory water passing through the first heat exchanging pipe 110 and the cap 200 absorbs heat energy to be heating water or hot water while sequentially flowing through the second and third heat exchanging pipes 120 and 130. Then, the heating water is discharged through the water outlet pipe 60 to locations which require heating by means of a circulation pump.

Next, after performing the heat exchange at locations which require heating and becoming cold water, the heating water or hot water is again introduced through the water inlet pipe 100 into the heat exchanger. This cycle is continuously repeated.

When the operation of the boiler stops after the completion of the cycle, the pipes are filled with the cold water. When the boiler operates again in this state, the cold water introduced through the water inlet pipe 100 into the heat exchanger is heated while passing through the outer pipe 110*a* and the inner pipe 110*b*. Thus, the heating water can be supplied without the creation of the condensate water.

Meanwhile, the water inlet pipe 100 may be formed with only one pipe. Preferably, the water inlet pipe 100 includes plural pipes, as shown in FIG. 4. In the case of a plurality of water inlet pipes, heat transfer area becomes wide, thereby increasing heat transfer efficiency.

MODE FOR THE INVENTION

Figure 5:
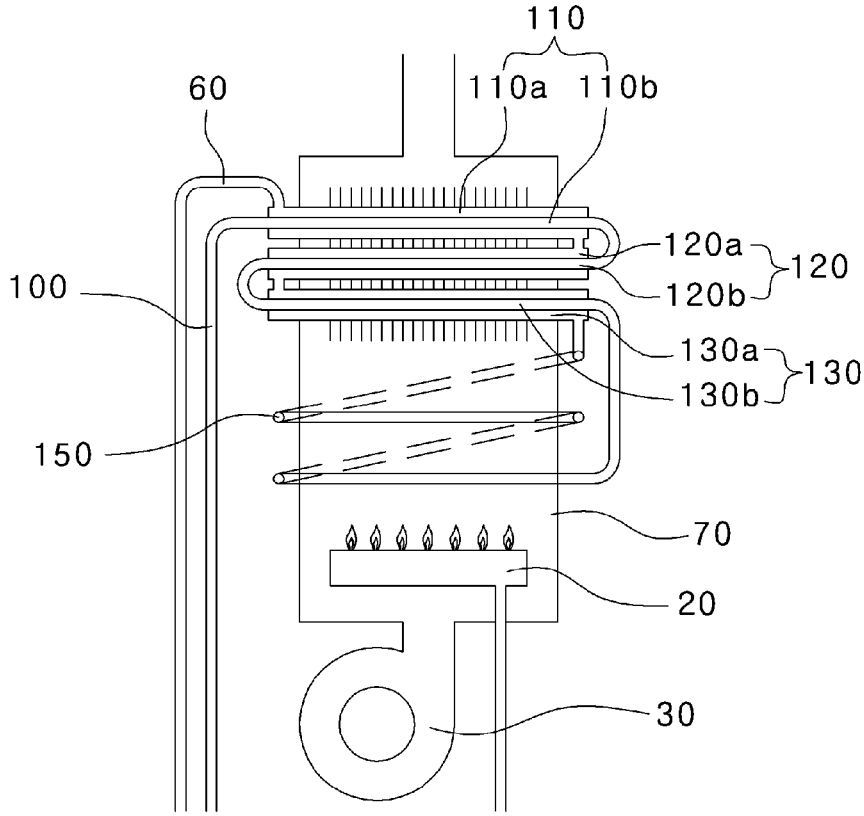
FIG. 5 is a schematic view showing a hot water supplying apparatus according to another embodiment of the present invention.

FIG. 5 is a schematic view showing a hot water supplying apparatus according to another embodiment of the present invention.

The first heat exchange pipe 110 is formed with a dual pipe including an outer pipe 110*a* directly heated by combustion heat of the burner 20 and an inner pipe 110*b* mounted in the outer pipe 110*a*.

The first heat exchange pipe 110 is sequentially connected to second and third heat exchange pipes 120 and 130 which include outer pipes 120*a* and 130*a*, and inner pipes 120*b* and 130*b*.

The inner pipe 130*b* of the third heat exchange pipe 130 is connected to a return pipe 150 which comes into contact with and is wound on an outer wall of a combustion chamber 70.

According to the structure of the hot water supplying apparatus, the cold water is initially introduced through the water inlet pipe 100 into the inner pipes 110*b*, 120*b*, and 130*b* of the first, second and third heat exchanging pipes 110, 120 and 130, and then is heated by the hot water filled within the outer pipes 110*a*, 120*a*, and 130*a*.

The water firstly heated in the inner pipes 110*b*, 120*b*, and 130*b* is secondly heated while passing through the return pipe 150. The return pipe 150 is in contact with and wound on a peripheral surface of the combustion chamber 70, so that the heat in the combustion chamber 70 is transferred to the return pipe 150.

The water secondly heated in the return pipe 150 is thirdly heated while sequentially passing through the outer pipe 130*a* of the third heat exchanging pipe 130, the outer pipe 120*a* of the second heat exchanging pipe 120, and the outer pipe 110*a* of the first heat exchanging pipe 110.

The water, which is heated during the above-mentioned processes, is supplied through the water outlet pipe 60 and is used as the calefactory water or hot water.

Further, the present invention having the above-mentioned structure can be applied to apparatuses for supplying hot water.

INDUSTRIAL APPLICABILITY

As described above, the present invention is applicable for the apparatuses of supplying hot water so as to raise the temperature of the cold water introduced through the water inlet pipe, thereby preventing the creation of the condensate water and the corrosion of parts of the hot water supplying apparatus.

The invention claimed is:

1. A hot water supplying apparatus comprising:

a burner for supplying heat;

a water inlet pipe for supplying cold water;

a heat exchanging pipe formed with a dual pipe including an outer pipe for directly receiving combustion heat from the burner, and a plurality of inner pipes formed in the outer pipe, where the inner pipes are connected to the water inlet pipe, for allowing the cold water, which is introduced through the water inlet pipe, to be heated while passing through the plurality of inner pipes; and a water outlet pipe for discharging the heated water from the heat exchanging pipe, wherein the plurality of inner pipes are arranged in parallel, and inserted into the outer pipe, wherein the plurality of inner pipes are inserted to a desired depth into the outer pipe, while the cold water introduced into the plurality of inner pipes are blocked by a sidewall of the outer pipe so as to flow in an opposite direction to the introduced direction.

2. The hot water supplying apparatus as claimed in claim 1, wherein caps for providing fluid path are installed to close one end of first and second heat exchanging pipes, through which the water inlet pipe extends.

3. The hot water supplying apparatus as claimed in claim 1, wherein a return pipe is in contact with an outer wall of a combustion chamber for secondly heating water which is firstly heated in the plurality of inner pipes, and is connected to the outer pipe in order to thirdly heat the water heated in the return pipe.

4. The hot water supplying apparatus of claim 1, wherein the plurality of inner pipes and the outer pipe extend in a longitudinal direction such that the outer longitudinal surfaces of the inner and outer pipes face the burner.

5. The hot water supplying apparatus of claim 1, wherein the plurality of inner pipes extend substantially into the outer pipe.

6. The hot water supplying apparatus of claim 1, wherein the plurality of inner pipes and the outer pipe extend in a horizontal direction substantially parallel with the burner.

7. The hot water supplying apparatus of claim 1, wherein the outer pipe is positioned and arranged so as to first receive the heat from the burner, and then the heat is transferred from the outer pipe to the plurality of inner pipes.

8. The hot water supplying apparatus of claim 1, wherein plurality of inner pipes are separate and distinct from each other.

* * * * *